US005890258A

United States Patent [19]

Lee

[11] Patent Number: 5,890,258

[45] Date of Patent: Apr. 6, 1999

[54] CARPET CLEANER WITH PULL-OUT TRAY SUPPORT FOR SERVICE AND REPAIR OF COMPONENTS

[76] Inventor: Kyu H. Lee, 1633 W. 134th St., Gardena, Calif. 90249-2013

[21] Appl. No.: 832,243

[22] Filed: Apr. 3, 1997

[51] Int. Cl.[6] ..... A47L 11/30

[52] U.S. Cl. ..... 15/320; 15/339

[58] Field of Search ..... 15/320, 321, 353, 15/339

[56] References Cited

U.S. PATENT DOCUMENTS

| | | | |
|---|---|---|---|
| 2,978,719 | 4/1961 | Arones | 15/320 X |
| 3,866,541 | 2/1975 | O'Connor et al. | 15/320 X |
| 5,237,719 | 8/1993 | Dwyer et al. | 15/320 X |
| 5,465,456 | 11/1995 | Fellhauer et al. | 15/320 |
| 5,715,568 | 2/1998 | Berfield et al. | 15/321 X |

*Primary Examiner*—Chris K. Moore
*Attorney, Agent, or Firm*—Willie Krawitz

[57] ABSTRACT

A carpet cleaner device and method having feed and dispensing lines for applying and removing cleaning solutions from carpets, upholstery, floors and similar surfaces is disclosed. Connections to these lines, and also connections for electric power are mounted on a tray which is supported within the device during use. The tray may be pulled out from the device to expose the lines and connections for ready access during servicing, and/or repair.

3 Claims, 2 Drawing Sheets

43a
42
41

45
45a
43
41
20
38
19
46
37
34
33
35
50
52
51
32
31
17
18
16
10
10a

CARPET CLEANER WITH PULL-OUT TRAY SUPPORT FOR SERVICE AND REPAIR OF COMPONENTS

BACKGROUND OF THE INVENTION

This invention relates to a new and improved carpet cleaner supply and recovery tanks which enable easy access to various components of the device such as solution connection lines, electrical connections, electrical components, and the like. Normally during use of similar prior art devices, servicing of these items is difficult since they are typically positioned at the bottom of the carpet cleaner, and hence access to these items is quite awkward, or it necessitates a partial or complete disassembly of the device for these purposes. This may require the device be serviced by the manufacturer or by a service company, or to employ specially trained personnel to service the equipment, all of which tend to be expensive. In any event, service and repair time is expensive, and returning the device to a manufacturer or service dealer means the device is taken out of service, which represents an added expense.

Also if the device is used frequently, it may be more cost effective to simply remove and replace some or all of these items with new components, rather than undergoing a service or repair routine. The above conditions would apply irrespective of whether servicing or replacement is made by a frequent user who is not commercial, or by a commercial user such as a janitorial service operator.

It would be desireable to provide a carpet cleaner device whose major components are readily accessible for inspection, servicing, repair, replacement, adjustment, cleaning and the like in a relatively short time, and with personnel or users who do not require skilled training. A carpet cleaner device also is desired which may be used in both modes of dry vacuuming and carpet cleaning with cleaning liquids. A carpet cleaner is also desired which is compact, mobile, and where filling with fresh liquid, removal of used liquid from a carpet, and emptying of used cleaning solution from the device is easily facilitated.

THE INVENTION

According to the invention, there is provided a carpet cleaning device having a built-in tray which supports the various components of the device, and which can be pulled out from the device when access to the components is desired. Use of this tray pull-out arrangement provides a support for motor components which apply suction and liquid application, and also interior hose lines, the components being self-contained within the device during regular use. When servicing is required, the support tray is pulled out from the device and exposes these components for easy servicing such as cleaning, adjustment, replacement of filters, repair, replacement, and so forth. The liquid reservoir tanks of the device are also self contained and are readily accessible for filling purposes, and the entire arrangement provides a compact package. Also, the compact construction and low center of gravity of the tray maintains the device balanced when the tray and supported components are pulled out. As indicated, the carpet cleaning device may be employed in a dry, vacuum cleaner mode, besides being used for liquid cleaning.

DESCRIPTION OF THE PREFERRED EMBODIMENTS

Figure 2:
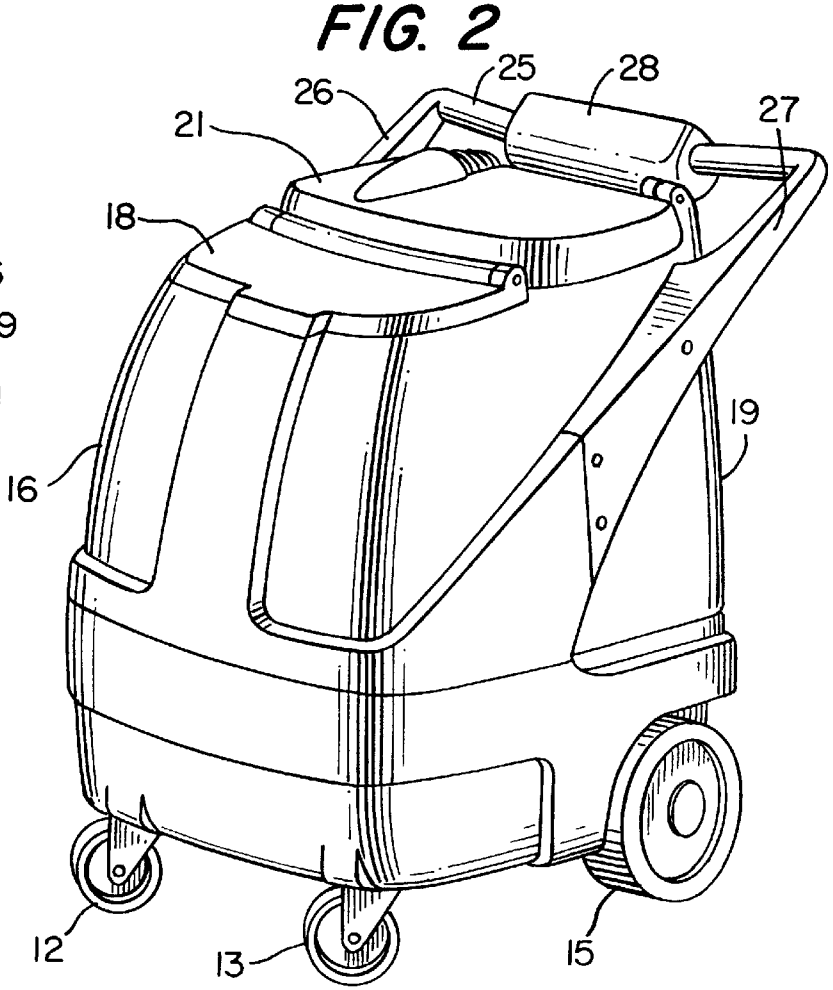
FIG. 2 is an external, perspective view of the carpet cleaning device showing the pull-out device support tray retracted into the device, and ready for operation.
Figure 1:
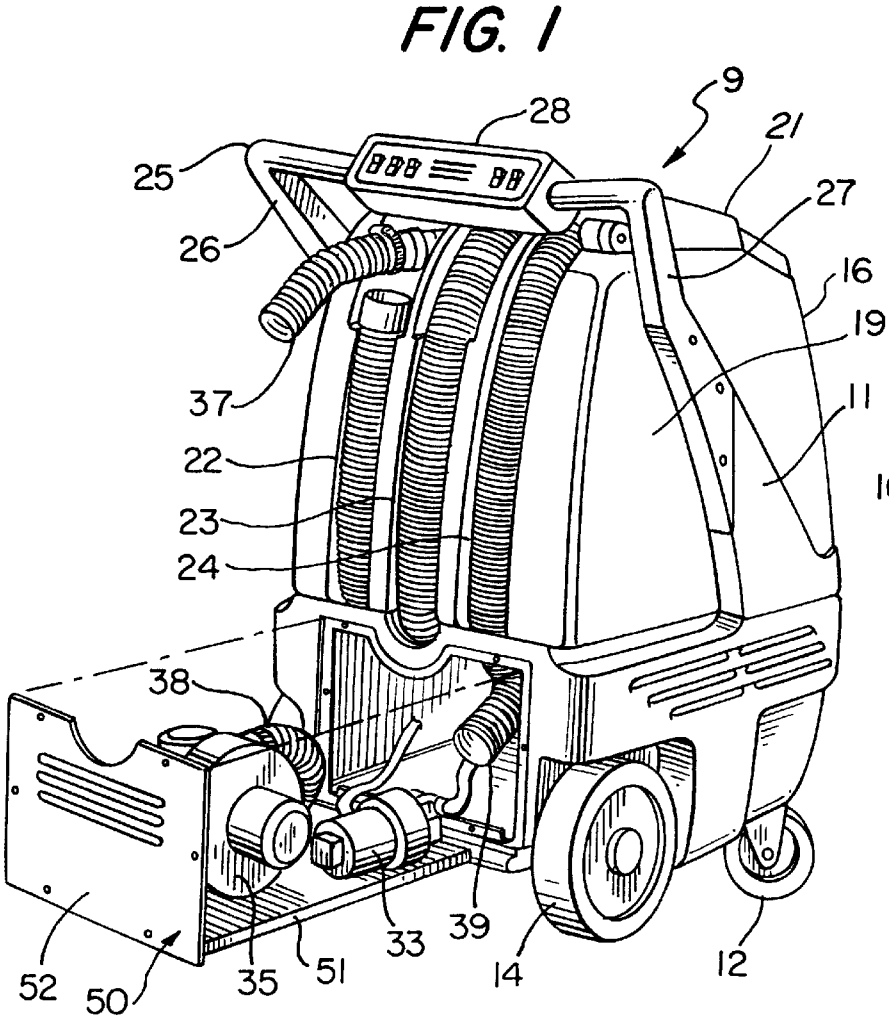
FIG. 1 is an external, perspective view of the carpet cleaning device of this invention showing the pull-out support tray in an extended position and suitable for servicing.
Figures 3, 4:
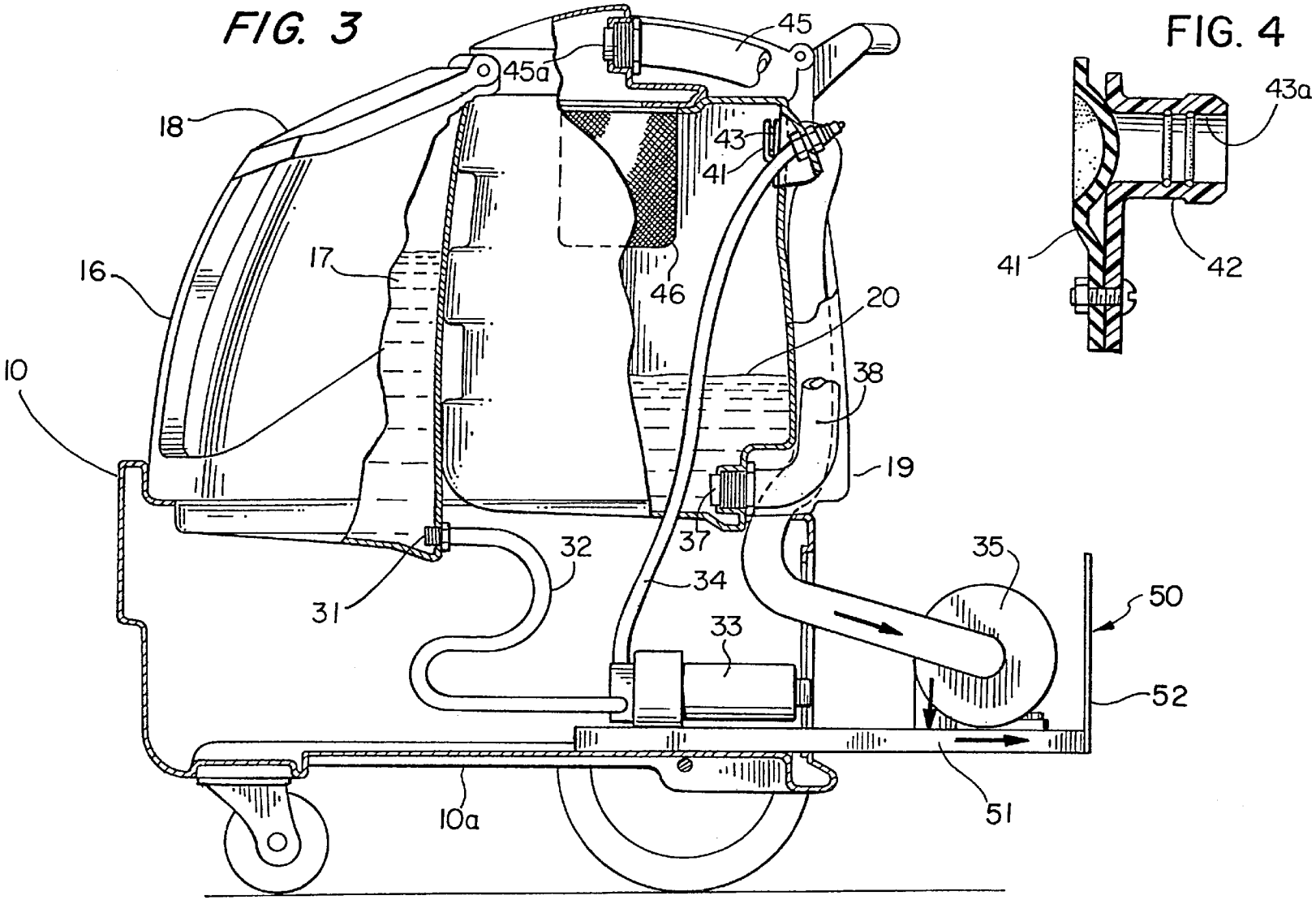
FIG. 3 is a cross section view in side elevation showing the interior of the carpet cleaning device, the pull-out tray being in a partially extended position; and, FIG. 4 is a cross section view in side elevation showing a flapper closure element for a liquid cleaning line.

The carpet cleaner device 9 of this invention is shown in FIGS. 1, 2 and 3 providing a base support 10, flat bottom 10*a*, and plastic frame 11 the base support mounting front swivel wheels 12, 13 and rear wheels 14 and 15. As shown in FIG. 3, the base support is configured to support a reservoir tank 16 for containing cleaning solution 17, the tank being closed by a rotatable cover 18. A recovery tank 19 is mounted rearwardly of the device and interfits with the base support 11 and the reservoir tank 16. The recovery tank 19 contains used liquid 20 which is removed from a carpet following a cleaning application. The recovery tank 19 is closed by a rotatable vacuum seal cover 21, and the vacuum seal enables the return of used cleaning solution from the carpet to the reservoir tank using suction.

The rear portion of the recovery tank is configured with longitudinal recesses 22, 23 and 24 along which are fitted various flexible hose lines. A hollow handle 25 bolted to the tank 19 provides a pair of arms 26, 27 and a control panel section 28. Conventional electrical leads for actuating the pumps are contained within the handle.

As shown in FIGS. 1 and 3, the lower portion of the front tank 16 containing cleaning solution 17 provides a lower, threaded bore 31 to which is connected a flexible hose line 32. Cleaning solution is fed by a pump 33 from the tank 16 through a flexible hose line 34 connecting to a carpet cleaner, not shown.

Following a cleaning operation, used cleaning solution is removed from a carpet by connecting a flexible line 37 to an applicator tool and applying suction using a suction pump 35 applied through flexible line 38. Used solution is removed through flexible lines 37 and 39, the latter connecting to an inlet at the tank bottom. The used solution is then fed upwardly along a flexible line 38 and downwardly into the tank.

A flexible flapper valve 41 is mounted in a port 42 at the top of the recovery tank, the valve closing when suction pressure is applied by the suction pump 35, and the valve opens to relieve the vacuum when the suction pump is turned off. Used cleaning solution is removed from the recovery tank 19 by opening the vacuum seal cover 21 of the tank, and siphoning to drain.

When used for dry vacuum cleaning such as carpets, upholstery, etc., the hose line 34 is disconnected from the applicator, and replaced by a flexible hose line 45 which enters the recovery tank. Intake suction air is supplied to a line connecting vacuum line 38, the end 45*a* of which is positioned over an intake air filter 46 for filtering purposes. Vacuumed air is drawn into the vacuum line 38 using the suction pump 35.

The pull-out support tray 50 is shown in FIGS. 1 and 3, and provides a tray 51 which slides along the flat bottom 10*a* of the base support 10. An exterior wall segment 52 is mounted at the end of the tray 51 and seats flush with the exterior of the device when the support tray is closed. This arrangement shields the interior of the pull-out tray from user contact and from external projections during use.

Pumps 33 and 35 are mounted on the support portion 51 as well as a segment of the flexible line 39. The flexibility of lines 32, 34 and 39 enables the support tray 50 to be either pulled out or pushed in and closed without damaging the lines, or connections. When the support tray is pulled out, inspection, servicing of the pumps, lines, connections, filters, and/or outright removal and replacement of these components can be made without partially or completely dismantling the device itself.

The carpet cleaner and pull-out tray of this invention thus provide a compact device having easily accessible components and an efficient and simple operating system.

I claim:

1. A carpet cleaner with reservoir device, comprising:

a.) a movable support;

b.) a body portion mounted on the support;

b.) a reservoir tank and tank cover mounted on the support and within the body portion for supplying cleaning liquid to a carpet cleaning operation;

c.) a recovery tank and tank cover mounted on the support, within the body portion and adjacent the reservoir tank, for receiving used cleaning liquid from the carpet cleaning operation;

d.) a pressure pump and flexible line for supplying cleaning liquid from the reservoir tank to the carpet cleaning operation;

e.) a pump and flexible removal line for removal of used cleaning solution from a carpet cleaning operation and return of the used cleaning solution to the recovery tank; and, f.) a pull-out tray mounted adjacent the movable support, components of the carpet cleaner including the pressure and vacuum pumps and segments of the flexible supply and removal lines being supported and exposed on the pull-out tray, the components being accessible for inspection, maintenance, repair and replacement, the carpet cleaner being maintained balanced when the pull-out tray is open, and when the pull-out tray is closed, the components and user will be shielded from damage and user contact.

2. The carpet cleaner of claim 1, comprising a vacuum line for dry vacuum cleaning, the vacuum line being connected to the recovery tank, the vacuum line being powered by suction forces from said removal pump.

3. The carpet cleaner of claim 1, comprising a plurality of longitudinal recesses defined on the body portion, and segments of flexible lines are interfitted in the recesses.

* * * * *